United States Patent [19]

Meredith

[11] 3,999,391

[45] Dec. 28, 1976

[54] TIE-BACK ANCHOR COMPONENTS AND METHOD FOR A SHORING SYSTEM

[75] Inventor: John A. Meredith, Denver, Colo.

[73] Assignee: Meredith Drilling Co., Inc., Denver, Colo.

[22] Filed: June 12, 1975

[21] Appl. No.: 586,463

[52] U.S. Cl. ..... 61/39; 61/53.62

[51] Int. Cl.[2] ..... E02D 5/34

[58] Field of Search ..... 61/39, 53.52, 53.68, 61/35, 53.62; 52/155, 156, 157

[56] References Cited

UNITED STATES PATENTS

| | | | |
|---|---|---|---|
| 3,226,933 | 1/1966 | White | 61/39 |
| 3,815,368 | 6/1974 | Turzillo | 61/39 |

FOREIGN PATENTS OR APPLICATIONS

| | | | |
|---|---|---|---|
| 1,634,273 | 8/1970 | Germany | 61/39 |

*Primary Examiner*—Paul R. Gilliam
*Assistant Examiner*—David H. Corbin
*Attorney, Agent, or Firm*—C. B. Messenger

[57] ABSTRACT

A tie-back anchor and the method for use thereof in connection with shoring systems wherein support for upstanding shoring components is provided by a plurality of tension cables or tendons placed outwardly of an excavation into undisturbed earth structures. A hollow tubular element having outwardly extending discontinuous helix formed flight elements is augered into place. A plurality of load transfer pins or bolts extend inwardly within the tube structure to positions of potential interference with the tension cables and the longitudinally separated bushings locked on separate cables. After placement of the tube structure and loose cables, a high strength grout is introduced into the tube whereby subsequent tension loadings on the cables and bushings is transmitted by the grout to the interfering load transfer pins, the tube structure, the helix flights thereof and the supporting earth structure. Pretensioning components inclusive of tapered bushings and wedge locks are used to transfer the developed tension loadings to walers, soldier beams and the sheeting of the shoring system.

15 Claims, 8 Drawing Figures

24
26
23
15
18
22
26
27
28
26
27
21
19

36
31
4
34
23
15
33
22
31
26
27
29
21
31

24
26
15
26
37
33
31
37
26
31
19

24
36
27
31
33
26
32
25

TIE-BACK ANCHOR COMPONENTS AND METHOD FOR A SHORING SYSTEM

BACKGROUND OF THE INVENTION

When buildings are being erected, it is often necessary or desirable to complete an excavation so that a more stable earth structure for foundations can be reached or to provide basement levels for the building. To prevent cave-ins of the surrounding earth into the excavated area, shoring is placed at a position that will be outside the intended basement walls. The requirement for a structure adequate to withstand the loads that may be imposed while providing a relatively uncluttered work area has previously led to the provision of shoring systems that are supported at least in part by tie-backs or earth anchors. Necessarily, the loadings to which the shoring will be exposed and also the holding capability of various anchor systems is largely dependent on the type of earth structure that is to be excavated and full consideration must be given both to the characteristics of the earth structure where the anchors are to be set and also to the characteristics of the overburden thereabove. If rock or other heavily consolidated structures are involved at the levels to be excavated or at positions closely therebelow, the anchoring techniques used can be relatively simplified. In some instances the tie-backs or tendons are simply extended into the undisturbed rock structure and an anchor end or bushing for the tendon is grouted in place.

A related but more severe problem is encountered where anchors must be established in a more loosely consolidated earth structure. Under such conditions the tension loadings to be established in the tendons must be transferred to the earth structure in a manner that will allow distribution of such loadings efficiently into a larger bulk area or volumetric zone of the supporting earth structure. The problem is further complicated by the fact that the loadings tending to collapse the shoring system are increased when a loosely consolidated overburden type of material is being excavated.

Tie-backs, anchor and tendon installations for use in relatively loose soils are known in the shoring system field, and it is acknowledged that others have previously been concerned with the provision of land anchors for other tie down purposes. Land anchors used for tie down purposes in connection with the anchoring of building structures, vehicles, fences, utilities, etc. are not believed to be directly comparable especially if the anchors are driven from an above-ground site. For such installations the loadings are generally less than the strength of the main force distributing anchor element itself. One earlier type of anchor used for a comparable purpose is illustrated and described in an earlier U.S. Pat. No. 3,728,862 granted to the present inventor. In such earlier disclosure an anchor plate is used that is inserted with a minimum frontal area, and it is later turned to provide a maximum frontal area exposed to the supporting earth structure. Another tie-back for use in connection with excavations adjacent to rock type structures is shown in a patent to R. E. White, U.S. Pat. No. 3,226,933. The total loadings to be developed through use of the present invention are comparable to those contemplated in the White disclosure, but the method and means used herein for attainment of the desired anchor capability is believed to be at least as different from the earlier patent disclosure as the respective soil structures that are to be held.

SUMMARY OF THE INVENTION

While some distinctive components are used in connection with practice of the present invention, a significant part of the invention is concerned with the manner of use for such components that will provide the optimum result. Accordingly, the invention relates both to the method involved and to the distinctive features of the components and elements themselves singly and in combination. From the standpoint of concept and method, the invention provides a step system in which an anchor element is drivingly augered into place. The anchor is essentially a tube structure which has outwardly extending discontinuous helix formed flights at spaced positions and preferably of increasing diameter away from the entrance point. The anchor is set in place through use of a turning and driving drill stem type of apparatus. The anchor itself has a plurality of pins or bolts that extend inwardly into the tube structure with such pins being arranged in an aligned configuration. When the anchor is being set, the orientation of these load transfer pins must be known and established so that the pins come to rest along the top edge surface of the anchor tube.

The retaining force that will be exerted to hold the shoring in place is transmitted to the shoring components or walers disposed thereon by a plurality of flexible cables acting conjointly as a tendon for the transmittal of such forces. The cables of the conjoint tendon are essentially free one with respect to the other between the anchor component and the upstanding shoring. Since the distance between the shoring and the anchor may be a considerable length, it is worthwhile if the cables can be exposed between the anchor and shoring. The fact that the anchor is augered into place and that the cables are loose presents an entanglement problem if the cables are permanently attached to the anchor initially and before placement of the anchor. A further problem is inherent in the provision of an anchor having a minimum tube diameter when the total tension loading to be developed in the tendons may be greater than the tensile strength of the anchor tube structure itself. Under such conditions the transfer of loadings from each of the individual tendons to the anchor must be regulated so that the strength of the anchor and its holding capacity will not be exceeded. To accommodate such requirement the cables are extended different distances into the anchor tube, or the load transmitting bushings for the cables are at least disposed at spaced positions so that the load of each separate cable will be transmitted to and be accommodated by a separate length of the anchor. Best results have been obtained when the bushings for the separate cables are longitudinally separated. The spaced positioning is also necessary, since the bushings and cable are of an aggregated size that would cause interference between the bushings and the load transfer pins. When the cables are inserted and in their desired positions with the anchor in place, a high strength grout is introduced into the interior of the anchor tube. The grout surrounds the cables and bushings and holds these elements in the desired placement. The hardened grout becomes a load transmitting member which operates to transfer the tension loadings in the cables and bushings to the interior surface of the tube and to the spaced load transfer pins. With this arrangement the loadings from each cable are transmitted to only a portion of the longitudinal extent of the anchor. When properly designed, the tension loadings in the separate cables will be transmitted to separate sections of the anchor, and the ultimate strength of the anchor tube structure will not be exceeded even though the total load carried collectively by the multi-cable tendon is in excess of the ultimate tensile strength of the tube used in fabrication of the anchor. This same distribution of loading is, of course, beneficial from the standpoint of the earth structure itself, since the tendon loading will similarly be distributed through an extended volumetric loading zone. Components for the satisfactory use of the system and method are shown in the accompanying Figures.

DESCRIPTION OF THE PREFERRED EMBODIMENT

The components and elements used in connection with the present tie-back system are shown in the accompanying Figures. The major components used include an anchor, the tension cables comprising the main support tendon, grout joining the anchor and tendon, and wedge lock elements for establishing and holding tension forces in the collective tendon. Essentially the named elements are separate pieces that are applied and used in a step process to attain the desired operational arrangement and result.

Figure 1:
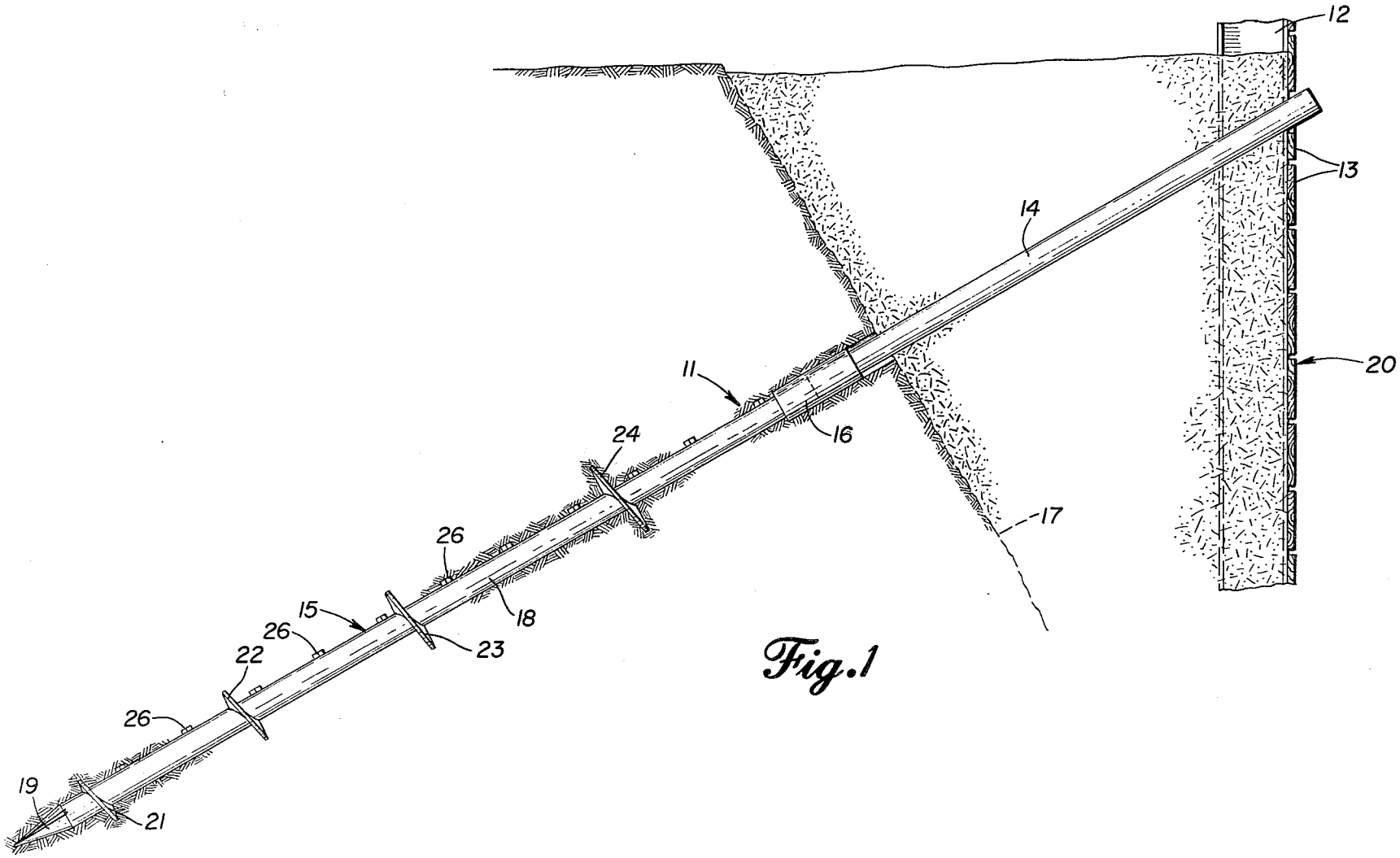
FIG. 1 is a side sectional elevation showing placement of the anchor component.

In FIG. 1 an anchor component 15 has been introduced past a soldier beam 12 of a shoring installation 20. The force used to place and turn the anchor 15 is transmitted by a section of drill stem 14. Earth drilling apparatus or horizontal boring type equipment is used to rotate the drill stem 14 and its drive collar 16. The drive collar is fitted to the anchor 15 to transmit both placing or retracting forces and powered rotary motion. The auger type anchor 15 is rotated and pushed outwardly into the unexcavated earth until the total anchor is in a section of undisturbed earth structure and at a position past a line 17 indicating a natural angle of repose for the illustrated earth structure. For the establishment of an optimum holding force, the anchor is driven outwardly and downwardly at angles of approximately 30° to 45°. If a more stable earth structure occurs at lower elevations, the angle of inclination of the tie-back system 11 is increased so that the anchor will be placed in an adequately stable structure at a minimum distance away from the shoring installation 20. The anchor 15 itself has a hollow tubular stem 18 that may be provided by ordinary pipe. Since substantial loadings are to be imposed, however, the pipe should for most installations be of rather heavy wall construction. Drill stem pipe of the type used in oil well drilling operations has been found to be satisfactory and economical since used materials are adequate.

The forward end of the tube 18 is tapered to provide a point 19, and segmental helix flights 21, 22, 23 and 24 are welded to the exterior surface of the tube structure. These segmental flights are formed from flat metal having a central opening of size to engage the exterior of the tube and with an outer circumference that is of increased diameter for the successive flights 21–24. In the formation of such flights the metal ring structure is cut to provide a slot 25, and subsequently the flight pieces are deformed in a press operation which conforms the shape to provide one turn of a helix formed screw. For the flights illustrated, the lead for the helix is approximately four inches and the schedule of spacing between successive flights is likewise determined on a 4 inch module so that if the anchor is rotated into place the following flights 22, 23, 24 will be successively engaged in the same path initially cut by the entrance flight 21. If the lead is not coordinated with the flight spacing, an undue amount of the earth structure will be disturbed, and the holding power thereof will, accordingly, be diminished.

The heads of a plurality of pins 26 are shown in FIG. 1. The heads, of course, are a part of the load transfer pins 26–27 that are more fully shown in FIGS. 2 through 5. In such illustrations the load transfer pins 26 are actually cap screws, the threaded ends 27 of which extend through the heavy sidewalls 28 of the tube structure 18. If threads are cut in the sidewalls 28, the pins can be securely placed to provide efficient load transfer. Smooth pins, or pins without heads, can be substituted if they are driven or welded in place.

Figures 2, 3, 4, 5:
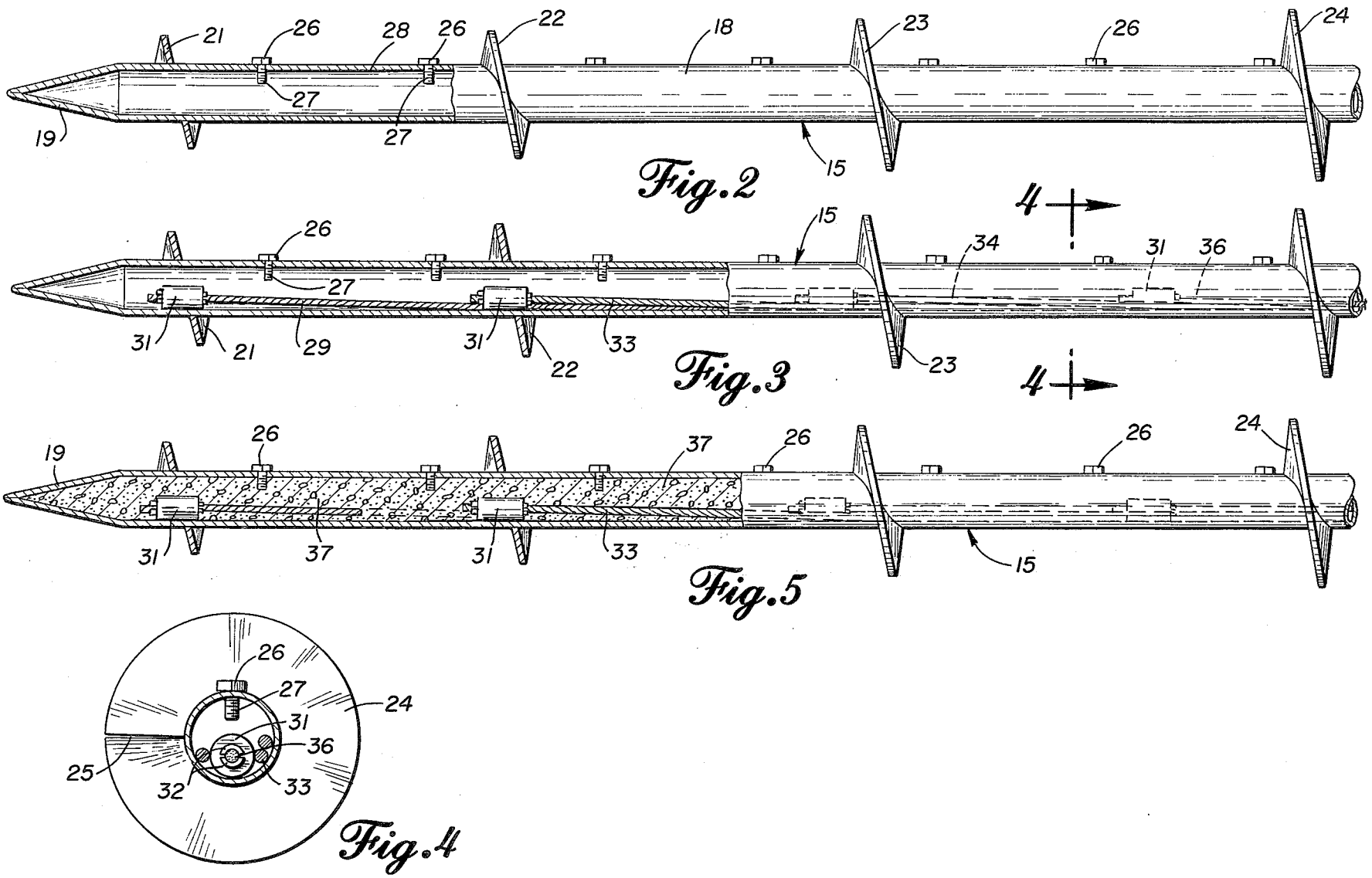
FIG. 2 is a side elevation in partial section showing features of the anchor component.
FIG. 3 is a side elevation similar to that of FIG. 2 showing introduction of the tension cables and bushings.
FIG. 4 is a cross-sectional elevation taken along the line 4—4 of FIG. 3.
FIG. 5 is a cross-sectional elevation similar to that of FIG. 3 showing introduction and placement of grout materials.
Figures 6, 7, 8:
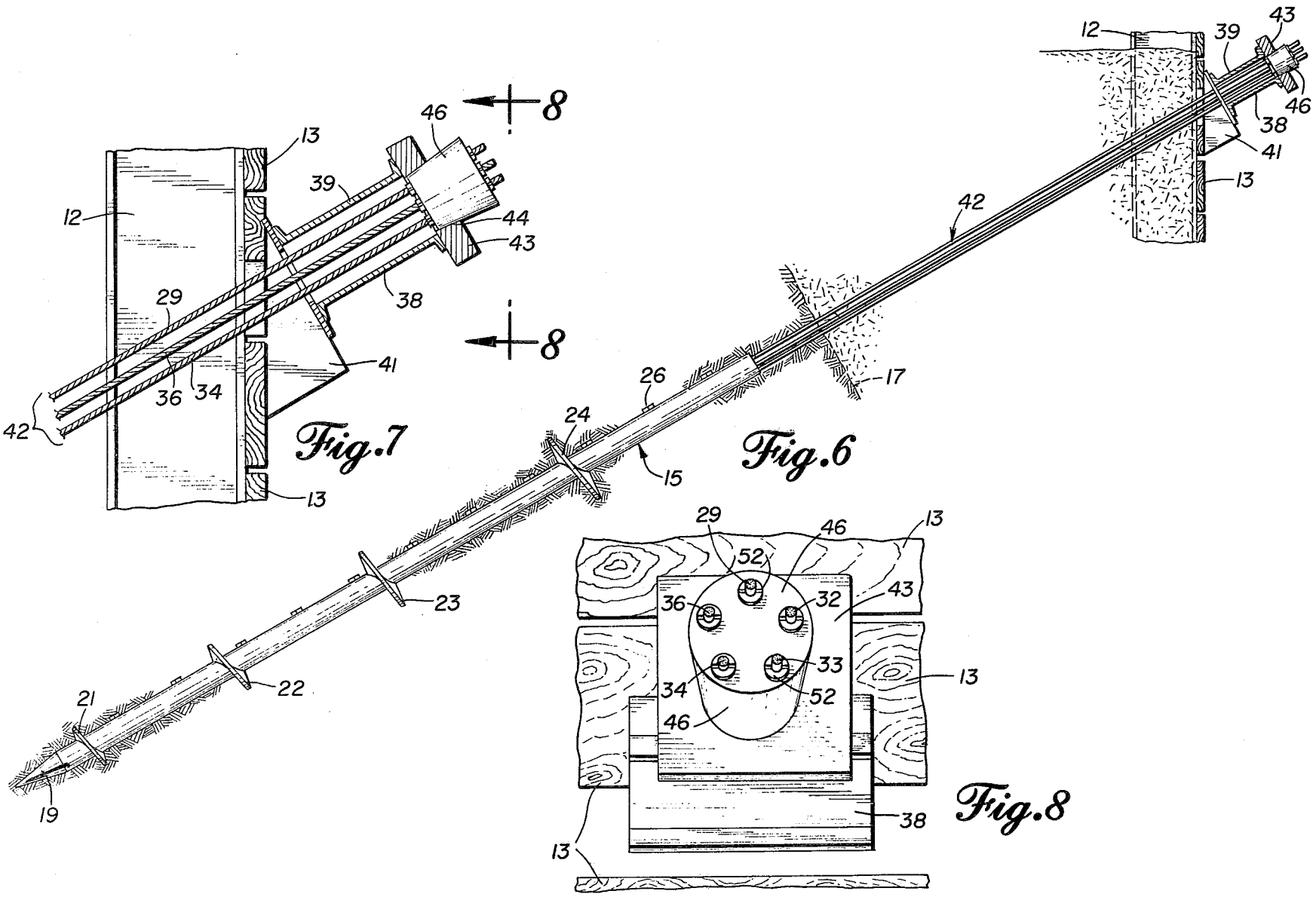
FIG. 6 is a side cross-sectional elevation similar to that of FIG. 1 showing the tie-back anchor in use.
FIG. 7 is an enlarged side view in partial section showing features of the cable tensioning components.
FIG. 8 is a front elevation taken along the line 8—8 of FIG. 7 showing further features of the tensioning apparatus.

In a preferred method of use, a plurality of cables are introduced into anchor 15 after it is in place. If the cables are to be introduced after placement of the anchor, the drive stem 14 is kept in place to guide the cables. Insertion of the cables is illustrated in FIG. 3. In this illustration the cable 29 extends almost to the point of the anchor structure 15. A bushing 31 is wedged or otherwise locked on the cable. A wedge locking type of arrangement often used in connection with pretensioning cables can be used. In such instances, as shown in FIG. 4, the bushing 31 has a central tapered opening, and separate wedge lock pieces 32 are inserted about the cable to be drawn into secure engagement with the individual wires thereof when tension forces are exerted on the cable. A plurality of separate tension cables 29, 33, 34 and 36 are provided within the anchor 15. Each cable has its own bushing 31, and the bushings are arranged in longitudinally spaced positions so that the main force transfer from the separate cables to the anchor 15 will be at longitudinally spaced positions. When the anchor component is being placed, it is important that all of the load transfer pins 26 are disposed in aligned positions and at the top of the anchor. If the pins are properly aligned and if the rotation of the auger is terminated at a time when the pins are on top, the separate tension cables and their respective bushings can be introduced along an undisturbed inner face of the tube structure. As shown in FIG. 4, the size of the bushings and the cables and the disposition of the load transfer pins 26 is such that the plurality of cables cannot be successfully placed if the separate bushings 31 are not distributively positioned or if the cables are allowed to become entangled.

After the cables and bushings are in desired position, a high strength grout can be introduced through the drive stem 14 and downwardly into the interior of the anchor 15 itself. The consolidated and cured grout 37 is shown in FIG. 5. If properly placed, the grout completely surrounds the cables and securely engages the wires of the cable and the lang and lay pattern thereof. The same grout 37 surrounds the bushings 31, and, accordingly, the cables will be effectively held in place. Loads imposed on the tension cables are transmitted by the grout to the load transfer pins 26 or to the interior of the walls of the tube structure 28 of the anchor. Loadings from the cables are by such combination transferred to the separate flights 21–24 for the anchor. Since the cables are separate and since the bushings are longitudinally spaced apart, the loading in each cable will essentially be transmitted to a different length or zone of the anchor 15 and by the flights of the anchor to a separate zone in the earth structure. This divided and displaced loading of the anchor not only efficiently distributes the load to the earth structure but it also prevents a potential failure of the anchor structure itself.

Design loadings to be imposed on this type of tie-back system can be quite substantial. For an initial installation each tie-back was to hold a loading of approximately 150,000 pounds. Such loading exceeds the tensile strength of readily available cables, and, accordingly, a plurality of cables are used. Such design strength, in fact, exceeds the tensile yield point for the tubular material used in construction of the anchor. Accordingly, if all of the cables were simply tied to the tube structure, a rupture thereof could be expected. With the described arrangement the total loading is distributed along the length of the tube, and yield strength is not exceeded.

After the grout has been placed, the drive stem 14 can be removed, and the cables thereafter extend through disturbed earth and to a point inwardly of the shoring system 20. To load the cables and to provide for transfer of the anchor loadings, paired walers 38 and 39 are positioned inwardly of the sheeting 13 for the shoring system. The walers are separate channel sections welded or otherwise held in spaced apart positions. The waler structure spans a plurality of soldier beams 12, and wedges 41 hold the walers in angled position so that the cables that collectively provide the tendon 42 are disposed at right angles to the operational face of the walers 38–39. In order to establish the desired loadings in the tendon, techniques used in prestressed concrete construction operations can be used. A plate 43 having a tapered socket engages a pretensioning bushing 46. The conically formed bushing 46 has a plurality of tapered holes drilled therethrough, through which the individual cables 29–36 are inserted. Wedge lock pieces 52 are again inserted about the separate cables. Loadings are established in the separate cables by the pretensioning apparatus, and subsequently the cone bushing 46 is placed with respect to plate 43, and all of the wedges 52 are engaged about the separate cables and in separate tapered holes of bushing 46. Subsequent release of part of the tension forces in the cables pulls the wedges 52 into tight engagement in their conical sockets as the cone bushing is similarly pulled inwardly in the tapered socket provided by plate 43. Since all the cables in the overall tendon 42 are usually to be tested at loadings in excess of the design or working load, the release of a part of the applied tension forces can serve the dual purpose of relieving excess test loadings and tightening the bushings and wedges. For most installations the bushing 46 does not itself have to be tapered. A straight cylindrical bushing can be placed on top of a plate 43 which simply provides an opening for the passage of the cables. Bushings of this type are available for concrete prestressing operations. For such bushings the wedges 52 disposed in their tapered sockets provide an adequate gripping force for locking the cable to the bushing.

The completed installation has several inherent advantages inasmuch as the full loadings developed in each of the separate cables is delivered essentially to a separate zone of an elongated anchor element. The zonal distribution of loadings in the anchor are in turn distributed to separate zones of the earth structure by reason of the interrupted screw flight design. The establishment of the longitudinally dispersed loading zones is accomplished in keeping with the present invention in a manner that is efficient, economical and highly beneficial.

I claim:

1. A method providing tie-backs for use when shoring excavations comprising drivingly augering hollow elongated anchor elements into undisturbed earth and outwardly away from the shoring components at an excavation site, providing separate load transfer elements that are fixed to and extend outwardly of said hollow anchor at patterned longitudinally spaced positions, placing ends of a plurality of separate tension elements having localized load transfer protrusions thereon within said hollow anchor in patterned arrangement whereby the separate protrusions of separate tension elements are disposed at longitudinally separated positions within said anchor with the opposite ends of said tension elements extending to a work position inwardly of said shoring components, introducing a grout material into the interior of said hollow anchor to surround and engage said tension elements, the protrusions thereon and the inner walls of said hollow anchor whereby said tension elements are securely held in place within the hollow anchor when the grout is cured, providing support elements at said shoring components, and establishing and holding tension loadings in each of said tension elements for conjointly holding said shoring in place whereby loads exerted against the shoring are transferred by the separate tension elements to longitudinally dispersed zones of said anchor and by the outwardly extending load transfer elements of said anchor to longitudinally dispersed zones of the supporting earth structure.

2. the method as set forth in claim 1 and further comprising the additional step of providing additional load transfer elements to extend inwardly of said hollow anchor to be engaged by said grout.

3. The method as set forth in claim 2 wherein said inwardly and outwardly extending load transfer elements are separate one from another.

4. The method as set forth in claim 3 wherein the inwardly extending load transfer elements are disposed in spaced patterned positions along the wall of said hollow anchor.

5. The method as set forth in claim 4 wherein said inwardly extending load transfer elements are disposed in aligned positions along the wall of said hollow anchor.

6. The method as set forth in claim 4 wherein the drivingly augered positioning of said anchor is halted when the inwardly extending load transfer elements are disposed along the topmost wall surface of said anchor.

7. The method as set forth in claim 2 wherein the outwardly extending load transfer elements are of discontinuous helix form to facilitate the augered driving of said anchor.

8. The method as set forth in claim 7 wherein said outwardly extending discontinuous load transfer elements are of increasing exterior diameter away from the entrance end for said anchor whereby the shoring loads are transferred additionally to laterally dispersed zones of the supporting earth structure.

9. Shoring tie-backs inclusive of anchor and tendon components for use in shoring excavation operations, said anchor component comprising a hollow tubular structure and helix flight elements extending outwardly from said tube structure and secured thereto for force transmitting engagement in undisturbed earth structures disposed outwardly from the shoring, said tendon component for the transmission of tension loadings from said anchor component to the excavation shoring for the support thereof comprising a plurality of separate tension cables having the anchor ends thereof disposed within the tubular structure of said anchor and with the opposite ends of said tension cables extending to a work position inwardly of said excavation shoring, load transfer protrusions affixed to each of said tension cables with the protrusions for separate tension cables being disposed within the anchor component at longitudinally separated positions, and means for the introduction of a cementitions grout material to the interior of said anchor component for surrounding said cables and the protrusions thereof whereby said anchor and tendon components are held together when loadings are applied thereto with the load of separate tension cables being transmitted by related affixed protrusions to separate zones of said anchor.

10. The tie-back combination as set forth in claim 9 wherein said helix flight elements are discontinuous.

11. The tie-back combination as set forth in claim 10 wherein said helix flight elements are of increasing exterior diameter away from the entrance end for said anchor.

12. The tie-back combination as set forth in claim 9 and further comprising load transfer elements extending inwardly into the hollow anchor for engagement by the grout materials.

13. The tie-back combination as set forth in claim 12 wherein the inwardly extending load transfer elements are disposed in spaced patterned positions along the wall of said tube structure.

14. The tie-back combination as set forth in claim 13 wherein the inwardly extending load transfer elements are disposed in aligned positions along the wall of said hollow tube structure.

15. The tie-back combination as set forth in claim 13 wherein said load transfer elements extend inwardly within said hollow tube structure to a position of potential interference with respect to said tension cables and the protrusions thereon when said anchor is rotated away from a position where the inwardly extending load transfer elements are disposed along the topmost wall surface of said anchor.

* * * * *